US009174334B2

(12) United States Patent
Chen

(10) Patent No.: US 9,174,334 B2
(45) Date of Patent: Nov. 3, 2015

(54) HANDLE FOR SCREWDRIVER

(71) Applicant: GONG FONG ENTERPRISE CO., LTD., Tainan (TW)

(72) Inventor: Yu-Lum Chen, Tainan (TW)

(73) Assignee: GONG FONG ENTERPRISE CO., LTD., Tainan (TW)

( * ) Notice: Subject to any disclaimer, the term of this patent is extended or adjusted under 35 U.S.C. 154(b) by 281 days.

(21) Appl. No.: 13/902,469

(22) Filed: May 24, 2013

(65) Prior Publication Data

US 2014/0144296 A1 May 29, 2014

(30) Foreign Application Priority Data

Nov. 29, 2012 (TW) ..... 101223129 U

(51) Int. Cl.
*B25G 1/08* (2006.01)
*B25B 15/02* (2006.01)

(52) U.S. Cl.
CPC ..... *B25G 1/085* (2013.01); *B25B 15/02* (2013.01)

(58) Field of Classification Search
CPC ..... B25G 1/005; B25G 1/085; B25G 1/105; B25B 15/002; B25B 15/02
USPC ..... 81/177.4, 490, 438, 439, 492
See application file for complete search history.

(56) References Cited

U.S. PATENT DOCUMENTS

| | | | | |
|---|---|---|---|---|
| 1,772,040 | A * | 8/1930 | Dunlea | 81/177.1 |
| 5,499,562 | A * | 3/1996 | Feng | 81/177.4 |
| 7,398,712 | B1 * | 7/2008 | Hsieh | 81/177.4 |
| 7,958,804 | B2 * | 6/2011 | Badiali | 81/492 |

* cited by examiner

*Primary Examiner* — Hadi Shakeri
(74) *Attorney, Agent, or Firm* — Muncy, Geissler, Olds & Lowe, P.C.

(57) ABSTRACT

A handle for a screwdriver including a body having a first open end and a second open end and also provides an intermediate member which connects the one end to the other end. A space is defined in the body and located between the first and second open ends such that space communicates with the first and second open ends. Multiple first connection portions are formed in inside of the first open end and connected with a stop formed in inside of the space.

6 Claims, 6 Drawing Sheets

HANDLE FOR SCREWDRIVER

FIELD OF THE INVENTION

The present invention relates to a handle, and more particularly, to a handle of a screwdriver and a poly-sided cap is connected to the handle to seal the space in the handle.

BACKGROUND OF THE INVENTION

The conventional handle "B" of a screwdriver is disclosed in FIG. 6 and generally comprises a space "C" for storage of bits, and a cap "D" with threads is used to seal the space "C" so as to prevent the bits from dropping from the space "C". However, the conventional cap "D" is a cap with round connection portions on which thread is located and cannot be used with other handles with the corresponding connection portions having non-round shapes. Besides, the conventional cap is easily loosened such that the bits in the space "C" can easily drop from the handle "B".

The present invention intends to provide a handle of a screwdriver and improvise the shortcomings of the conventional screwdriver handle.

SUMMARY OF THE INVENTION

The present invention relates to a handle of a screwdriver and comprises a body having a first open end and a second open end which is located in opposite to the first open end. The first open end communicates with the second open end. A space is defined in the body and located between the first and second open ends. The space is in communication with the first and second open ends. Multiple first connection portions are formed in inside of the first open end and extending in the space. A stop is formed in an inside of the space and connected with the first connection portions.

An intermediate member has multiple second connection portions on outside thereof, and the second connection portions are located corresponding to the first connection portions. The intermediate member has a first end and a second end which is located in opposite to the first end. The first end contacts the stop and the second end contacts the first open end of the body. The intermediate member has third connection portions on inside thereof.

A cap has an extension which has multiple fourth connection portions, and the fourth connection portions are located corresponding to the third connection portions.

Preferably, the first connection portions are slots and the second connection portions are blocks which are engaged with the slots of the first connection portions.

Preferably, the third connection portions 24 are slots and the fourth connection portions are blocks which are engaged with the slots of the third connection portions.

Preferably, the cap is a poly-sided cap.

Preferably, the body has a first hole and the intermediate member has a second hole defined in one of the second connection portion. The second hole is located corresponding to the first hole.

Preferably, a filling material is filled between the first and second holes.

One of the advantages of the present invention is to provide a poly-sided cap to completely seal the space of the body of the handle.

Another one of the advantages of the present invention is to provide a first hole in the body and located corresponding to a second hole in the intermediate member, and the body and the intermediate member are firmly connected by filling a filling material therebetween.

Yet another one of the advantages of the present invention is to provide the cap with multiple fourth connection portions which are connected with the third connection portions on the intermediate member so as to prevent the cap from being loosened and to ensure that the bits in the space do not drop from the space.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
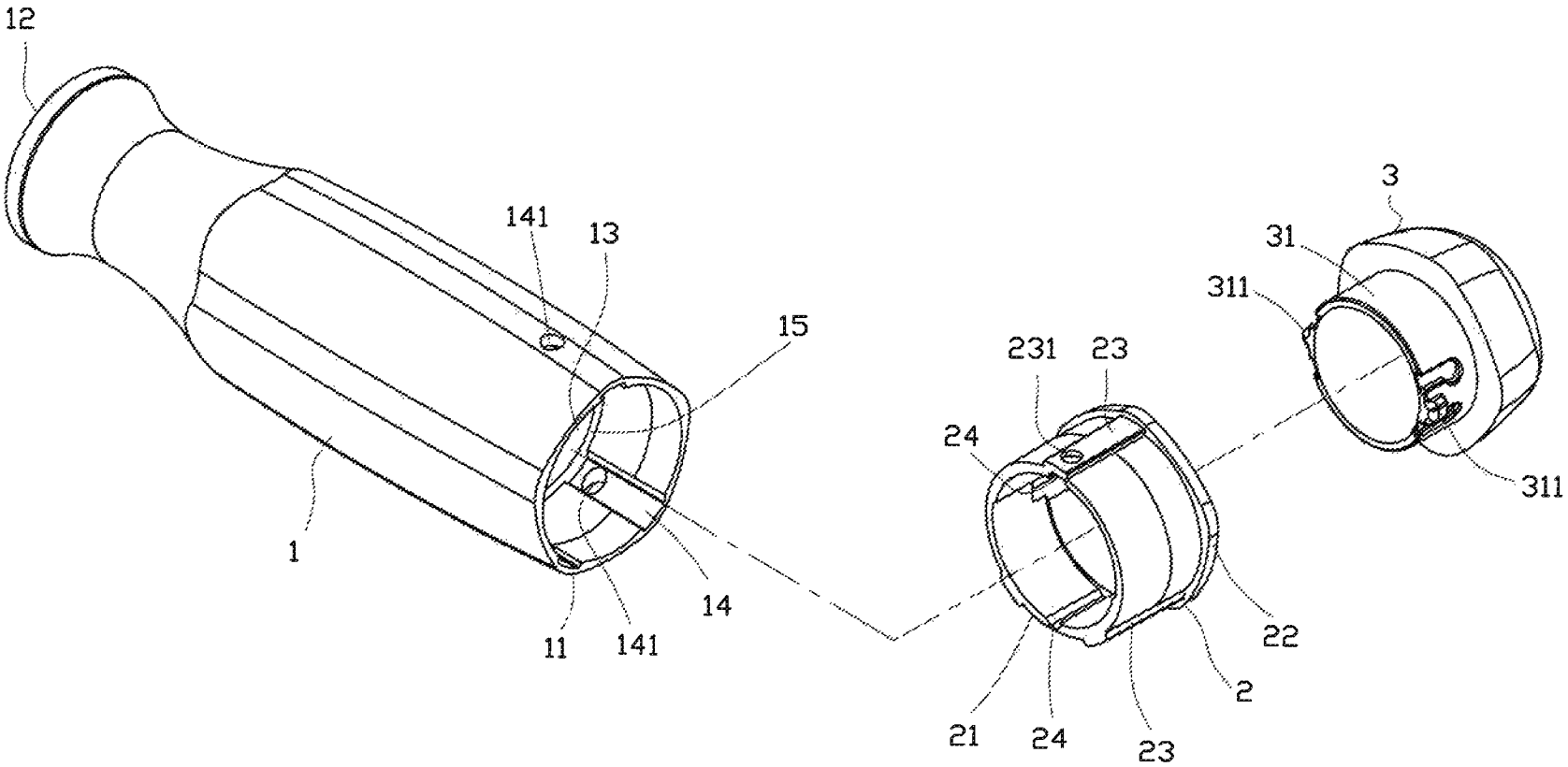
FIG. 1 is an exploded view to show the handle of the present invention.
Figure 2:
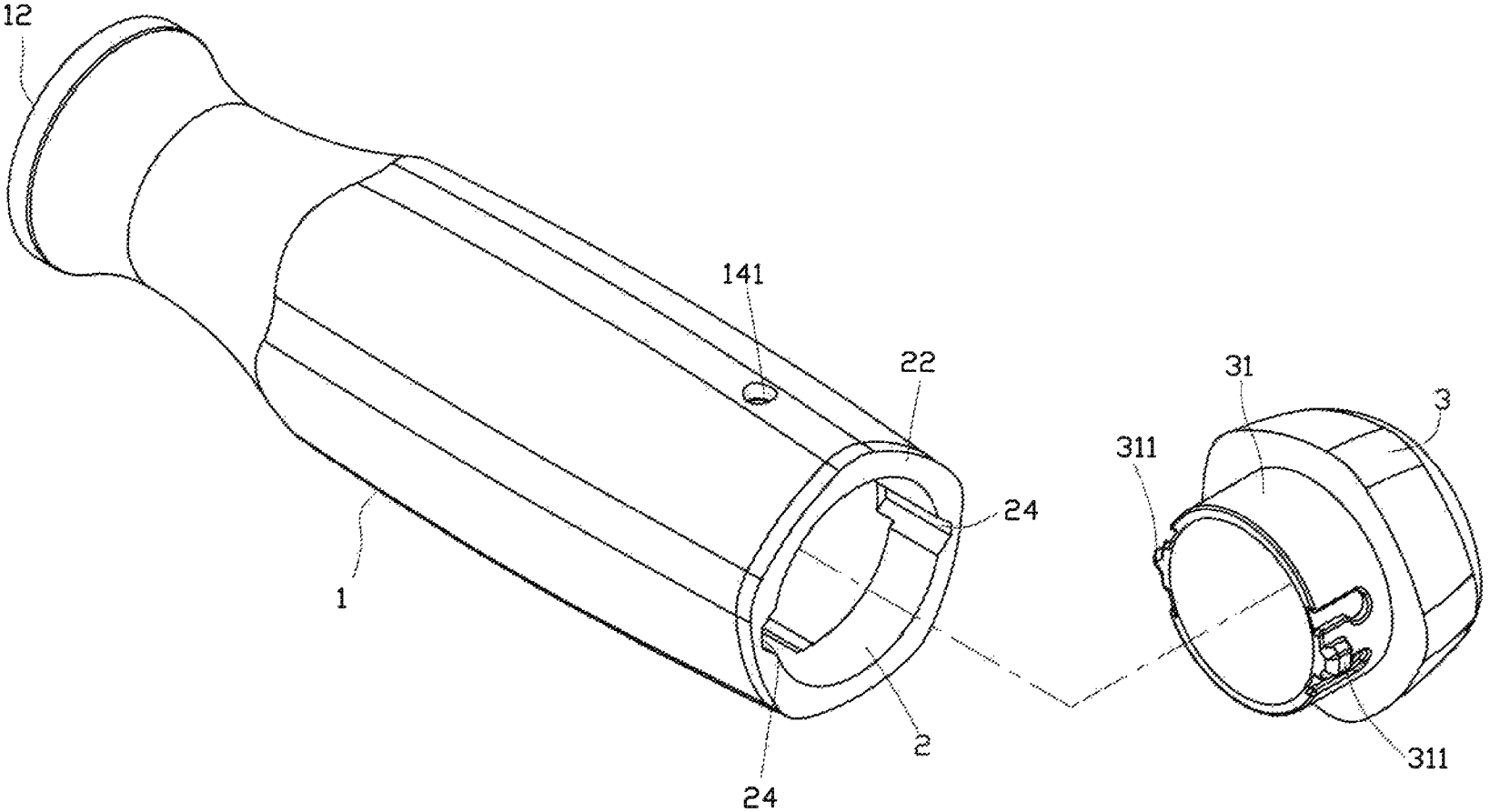
FIG. 2 is an exploded view to show that the intermediate member is installed to the body of the handle of the present invention.
Figure 3:
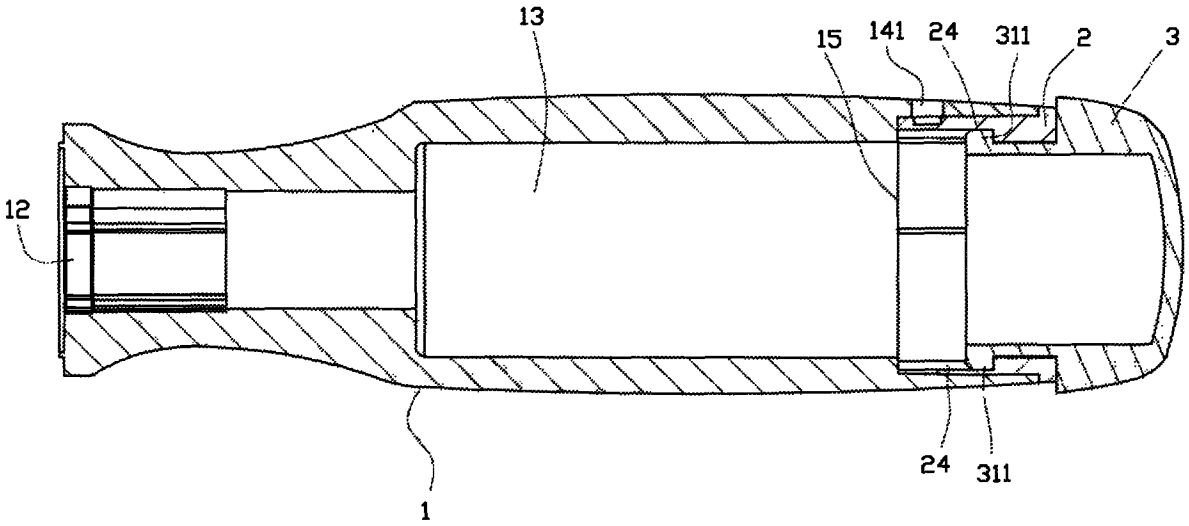
FIG. 3 is a cross sectional view of the assembled handle of the present invention.

Referring to FIGS. 1 to 3, the handle of a screwdriver of the present invention comprises a body 1 having a first open end 11 and a second open end 12 which is located in opposite to the first open end 11. The first open end 11 communicates with the second open end 12. A space 13 is defined in the body 1 and located between the first and second open ends 11, 12. The space 13 is in communication with the first and second open ends 11, 12. Multiple first connection portions 14 are formed in the inside of the first open end 11 and extend in the space 13. In this embodiment, the first connection portions 14 are slots. A stop 15 is formed in the inside of the space 13 and connected with the first connection portions 14. In this embodiment, the body 1 has at least one first hole 141.

An intermediate member 2 has multiple second connection portions 23 on outside thereof, and the second connection portions 23 are located corresponding to the first connection portions 14. In this embodiment, the second connection portions 23 are blocks which are engaged with the slots of the first connection portions 14. The intermediate member 2 has a first end 21 and a second end 22 which is located in opposite to the first end 21. The first end 21 contacts the stop 15, and the second end 22 contacts the first open end 11 of the body 1. The intermediate member 2 has multiple third connection portions 24 on inside thereof. In this embodiment, the third connection portions 24 are slots. The intermediate member 2 has a second hole 231 defined in one of the second connection portion 23, the second hole 231 is located corresponding to the first hole 141.

A cap 3 has an extension 31 which has multiple fourth connection portions 311. The fourth connection portions 311 are located corresponding to the third connection portions 24. In this embodiment, the fourth connection portions 311 are blocks which are engaged with the slots of the third connection portions 24, so that the cap 3 seals the second end 22 of the intermediate member 2.

Figure 4:
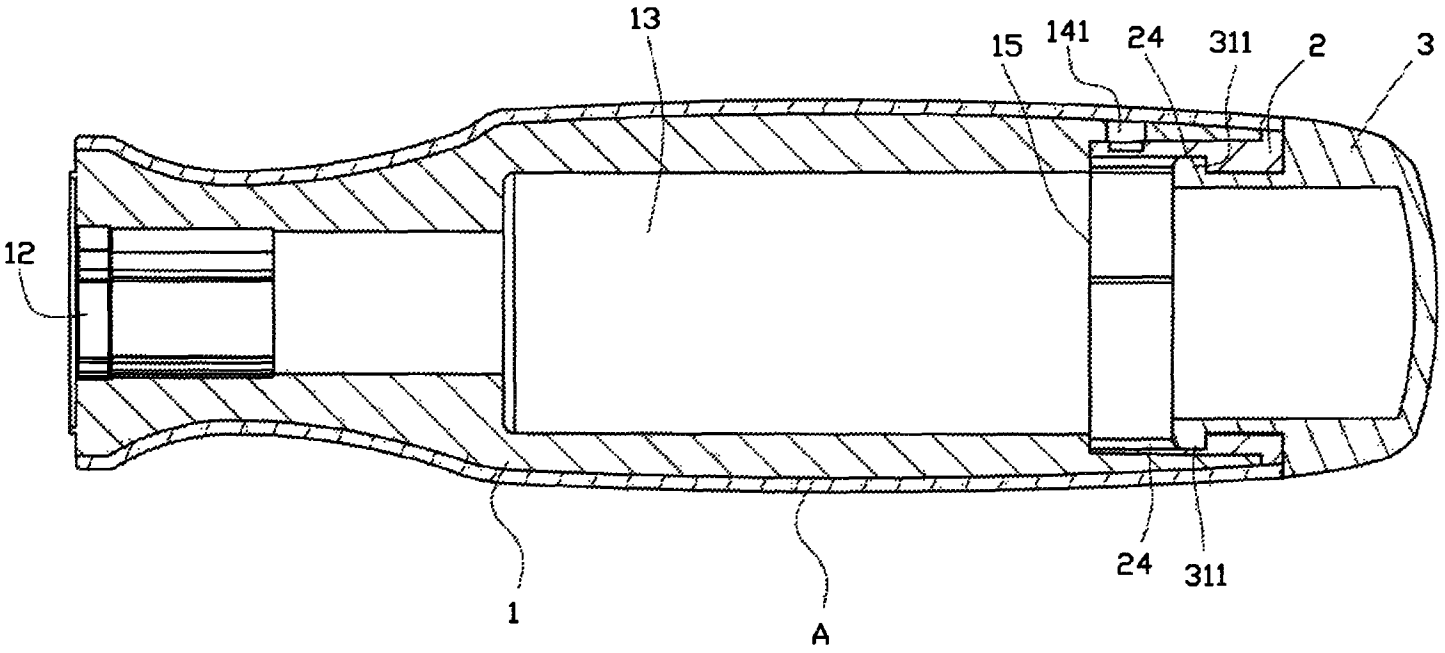
FIG. 4 is a cross sectional view of the assembled handle of the present invention wherein the filling material is shown.

As shown in FIGS. 3 and 4, the cap 3 is securely connected to the handle 1 by the engagement between the third and fourth connection portions 24, 311. Therefore, the bits in the space 13 do not drop from the space 13. More specifically, each of the third connection portions 24 comprises an upper part of the third connection portion 24 and a lower part of the connection portion 24. When assembling, the intermediate member 2 is firstly installed into the body 1, and the cap 3 is then installed to the intermediate member 2. While the cap 3 is installed to the intermediate member 2, the fourth connection portions 311 are firstly installed to the inner end of the upper parts of the third connection portions 24, and then the cap 3 is rotated to a specific angle and movably contacts with an inner part of the intermediate member 2, so that the fourth connection portions 311 are finally engaged with the lower parts of the third connection portions 24, and the cap 3 seals the second end 22 of the intermediate member 2.

Figure 5:
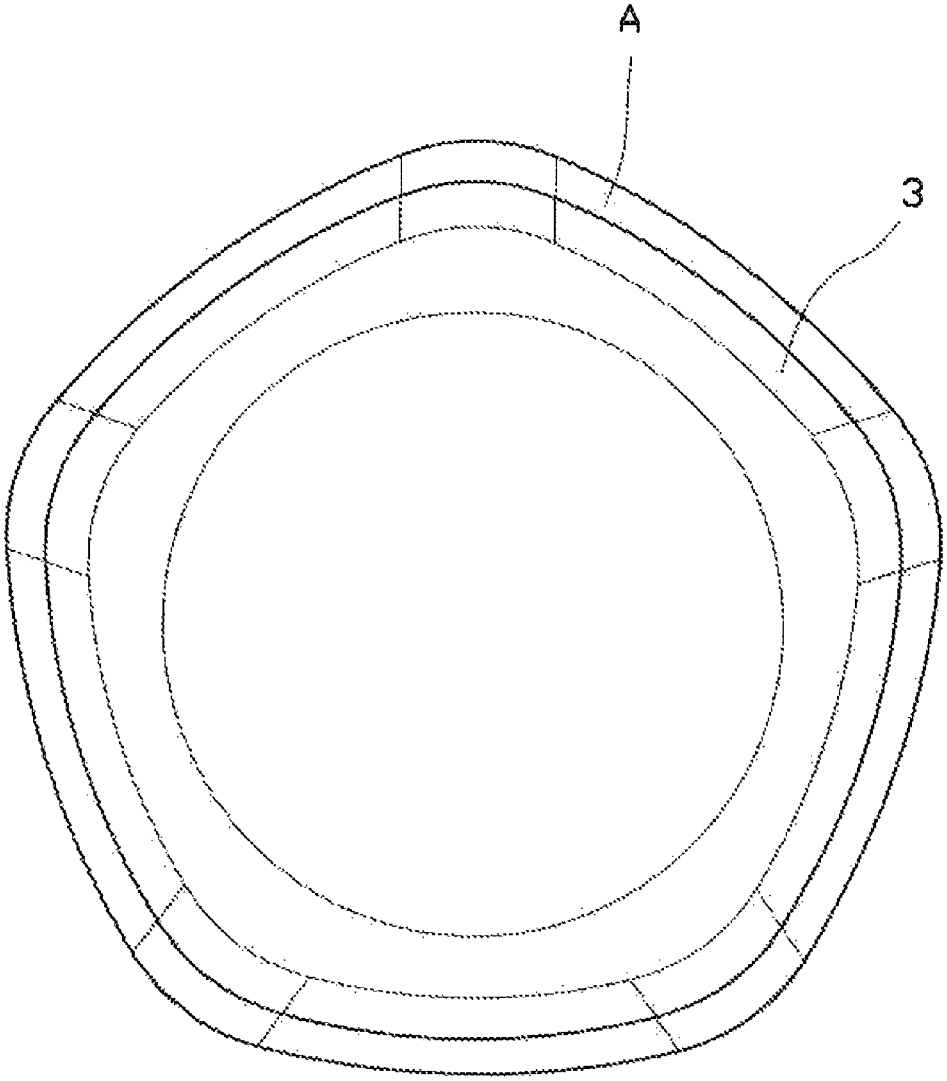
FIG. 5 is an right side view of the assembled handle of the present invention wherein the filling material is shown.
Figure 6:
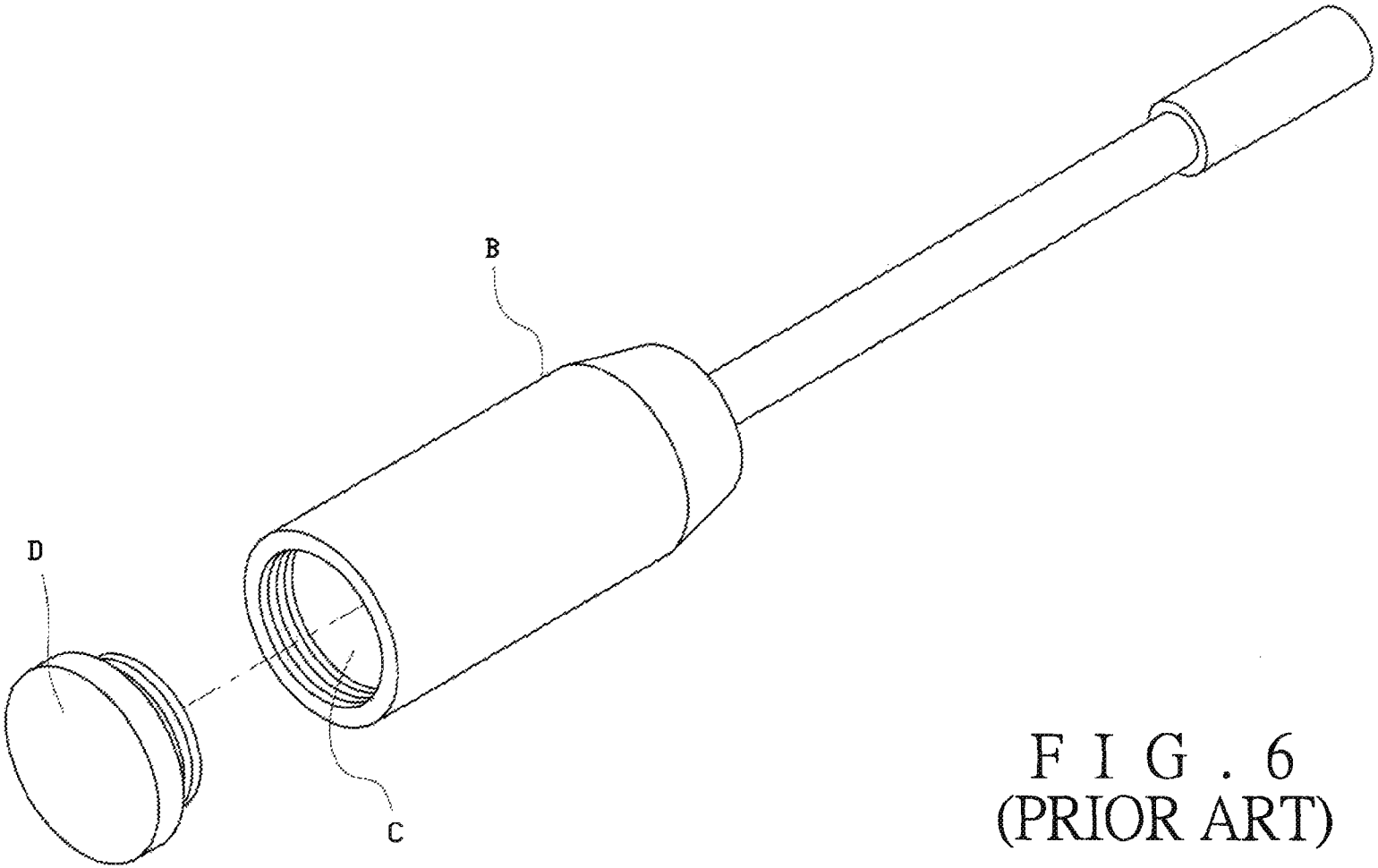
FIG. 6 (PRIOR ART)
FIG. 6 shows the conventional handle.

FIG. 5 shows that the cap 3 of the present invention can be configured to be a poly-sided cap. More specifically, by the arrangement of the first, second, third, fourth connection portions 14, 23, 24, 311 and the stop 15 among the body 1, the intermediate member 2 and the cap 3, especially by indirectly connecting the cap 3 to the body 1 through the intermediate member 2, the cap 3 is adapted to be installed to other handles with the corresponding connection portions having different shapes.

As shown in FIGS. 1, 4 and 5, when the second connection portions of the intermediate member 2 are engaged with the first connection portions 14 of the body 1, and when the first end 21 of the intermediate member 2 is contacting to the stop 15 of the body 1, the first hole 141 is located in alignment with the second hole 231. Under this arrangement, a filling material "A" is injected to fill between the aligned first and second holes 141, 231. Preferably, the outer of the body 1 is covered by the filling material "A". Wherein, the filling material "A" can be plastic material to securely connect the intermediate member 2 to the body 1.

While we have shown and described the embodiment in accordance with the present invention, it should be clear to those skilled in the art that further embodiments may be made without departing from the scope of the present invention.

What is claimed is:

1. A handle of a screwdriver, comprising:

a body having a first open end and a second open end which is located in opposite to the first open end, the first open end communicating with the second open end, a space defined in the body and located between the first and second open ends, the space being in communication with the first and second open ends, multiple first connection portions formed in an inside of the first open end and extending in the space, a stop formed in an inside of the space and connected with the first connection portions;

an intermediate member having multiple second connection portions on an outside thereof, the second connection portions located corresponding to the first connection portions, the intermediate member having a first end and a second end which is located in opposite to the first end, the first end contacting the stop and the second end contacting the first open end of the body, the intermediate member having multiple third connection portions on an inside thereof, and a cap having an extension which has multiple fourth connection portions, the fourth connection portions are located corresponding to the third connection portions.

2. The handle as claimed in claim 1, wherein the first connection portions are slots and the second connection portions are blocks which are engaged with the slots of the first connection portions.

3. The handle as claimed in claim 1, wherein the third connection portions are slots and the fourth connection portions are blocks which are engaged with the slots of the third connection portions.

4. The handle as claimed in claim 1, wherein the cap is a poly-sided cap.

5. The handle as claimed in claim 1, wherein the body has a first hole and the intermediate member has a second hole defined in one of the second connection portion, the second hole is located corresponding to the first hole.

6. The handle as claimed in claim 5 further comprising a filling material is filled between the first and second holes.

* * * * *